United States Patent [19]

Sato

[11] 4,026,758

[45] May 31, 1977

[54] PORTABLE LABELLING MACHINE

[76] Inventor: Yo Sato, 17-8, 4-chome, Izumi, Suginami, Tokyo, Japan

[22] Filed: Dec. 4, 1975

[21] Appl. No.: 637,767

Related U.S. Application Data

[63] Continuation of Ser. No. 377,777, July 9, 1973, abandoned.

[30] Foreign Application Priority Data

Oct. 5, 1972 Japan ..... 47-99441

[52] U.S. Cl. ..... 156/540; 156/577; 156/579; 156/584; 156/DIG. 49

[51] Int. Cl.[2] ..... B41F 1/08

[58] Field of Search ..... 156/384, 536, 540, 541, 156/556, 558, 568, 577, 578, 579, 584, DIG. 48, DIG. 49; 226/76, 82, 83, 156, 157; 101/291, 292, 269, 288; 221/73

[56] References Cited

UNITED STATES PATENTS

| | | | |
|---|---|---|---|
| 2,656,944 | 10/1953 | Swett | 156/384 |
| 3,075,569 | 1/1963 | Blumberg et al. | 156/541 |
| 3,265,553 | 8/1966 | Kind et al. | 156/584 |
| 3,265,553 | 8/1966 | Kind et al. | 156/584 |
| 3,330,207 | 7/1967 | De Man | 226/157 |
| 3,461,018 | 8/1969 | Nagashima | 156/577 |
| 3,611,929 | 10/1971 | Schrotz | 226/82 |
| 3,674,609 | 7/1972 | Schrotz et al. | 156/577 |
| 3,686,055 | 8/1972 | Hermann | 156/577 |
| 3,705,833 | 12/1972 | Wada | 156/577 |
| 3,782,279 | 1/1974 | Carboni et al. | 156/584 |

*Primary Examiner*—William A. Powell
*Assistant Examiner*—John E. Kittle

[57] ABSTRACT

A toothed rotor actuated by a hand-operated lever is mounted within the casing of a labelling machine for indexing a continuous label strip along a predetermined passageway through the casing. The continuous label strip consists of a series of individual labels separably laid over a common backing strip, the labels being successively printed with desired inscriptions, separated from the backing strip, and dispensed out of the casing to be adherently affixed to any desired article. The aforesaid passageway is defined by a plurality of guides swingably mounted within the casing in such a manner that by opening the pivoted bottom of the casing the guides can be swung interrelatedly to their respective inoperative positions, as for facilitating the initial loading and at the position manual threading of the continuous label strip along the passageway.

6 Claims, 10 Drawing Figures

PORTABLE LABELLING MACHINE

CROSS-RELATED APPLICATION

This application is a continuation of application Ser. No. 377,777, filed July 9, 1973 now abandoned, and claiming the priority of the application filed in Japan on Oct. 5, 1972.

BACKGROUND OF THE INVENTION

This invention relates generally to labelling machines, and more specifically to improvements in portable, one-hand-operable labelling machines of the type actuated by a lever for printing desired inscriptions on successive labels and for dispensing the printed labels to be adherently affixed to any desired article.

The labels for use in this type of labelling machines have a layer of pressure-sensitive adhesive coated on one face thereof through which the labels are releasably laid over a strip of common backing paper. The continuous strip of labels thus formed is fed by an indexing mechanism along a predetermined passageway through the labelling machine, and adjacent its dispensing opening the successive labels are separated from their common backing strip by various known mechanisms explained hereinbelow.

The continuous label strip for use with all these known mechanisms must be such that the individual lables are appropriately more rigid than the common backing paper. For example, there has been known a method in which only the backing paper of the continuous label strip to be fed in one direction is caused to make a 180° turn around a slender rod or around the edge of a thin plate. As the strip of backing paper is thus pulled in the opposite direction, the relatively rigid labels are successively separated therefrom and are fed in the said one direction. However, high frictional resistance is exerted on the backing paper being forcibly fed in close contact with the rod or plate, thereby resulting in the fatigue of the operator or in the breaking of the backing paper. Although the latter outcome can be obviated by the use of strong, high-quality backing paper, this measure increases the maintenance costs of the labelling machine.

Alternatively, there has been known a method in which the successive labels are fed in one direction by means of a reciprocating pawl while their common backing strip is fed in the opposite direction through a pair of contacting rollers. While this second method is advantageous in that the backing strip is fed in a substantially frictionless manner and that, consequently, less manual effort is required, these advantages are nearly offset by frequent trouble caused by the wear of the reciprocating pawl.

A further method has been known in which the successive labels together with their common backing strip are fed in one direction by means of a toothed rotor until the backing strip is reversed in direction and fed through a pair of contacting rollers to be separated therefrom. However, this arrangement increases the bulk and weight of the entire labelling machine to such an extent that the machine is no longer fit for use with one hand.

SUMMARY OF THE INVENTION

In view of the listed disadvantages of the prior art, it is an object of this invention to provide a novel and improved labelling machine in which the feeding in opposite directions of a continuous strip of labels and a common backing strip separated therefrom is accomplished by a single and compact means in such a manner that little manual effort is required.

Another object of the invention is to provide a labelling machine so constructed that the intial loading and the manual threading of the continuous strip of labels through its predetermined passageway are highly facilitated, and the internal mechanisms of the machine can always be maintained in good repair because of easy access permitted thereto.

A further object of the invention is to provide a labelling machine so constructed that the continuous strip of labels and the common backing strip separated therefrom are fed in their respective predetermined directions by precise indexed movement, so that desired inscriptions can be printed in position on each label.

A still further object of the invention is to provide a labelling machine permitting the use of relatively inexpensive backing paper as it is subject to no substantial tensile force.

According to this invention, briefly summarized, there are provided some improvements in a labelling machine of the type comprising a casing having a grip formed integral therewith, a lever swingable through a predetermined angle within the casing, and printing means mounted on the lever to print desired inscriptions on a continuous lable strip consisting of a series of labels releasably laid over a common backing strip, the continuous label strip being caused to travel by indexed movement along a predetermined passageway through the casing which includes a hairpin curve where the successive labels are separated from the backing strip to be dispensed out of the casing and to be adherently affixed to a desired article.

Characteristically, the improved labelling machine according to the invention includes a rotor mounted within the casing for rotation in one predetermined direction only and actuated by the aforesaid lever to index the continuous label strip and the backing strip along the passageway. A first guide is swingably mounted within the casing for guiding the continuous label strip along an upper circumferential portion of the rotor, the first guide having a pair of aligned pins projecting from both sides of its free end. A second guide also swingably mounted within the casing on the same axis as the rotor includes a base defining a part of the passageway such that the desired inscriptions are printed on the successive labels of the continuous label strip travelling thereon, and this second guide further includes a pair of parallel levers slotted longitudinally to slidably receive the respective pins of the first guide. The second guide is normally held in its operative position by an openable bottom swingably mounted at the lower end of the casing, so that when the bottom is opened, the first and the second guides can be swung interrelatedly to their respective inoperative positions so as to facilitate the loading of the labelling machine with the continuous label strip.

The features which are believed to be novel and characteristic of this invention are set forth with particularity in the appended claims. The invention itself, however, both as to its organization and mode of operation, together with the further objects and advantages thereof, will be best understood from the following description of a preferred embodiment taken in conjunction with the accompanying drawings in which like reference numerals desigate like parts throughout the several views.

DETAILED DESCRIPTION

Figure 1:
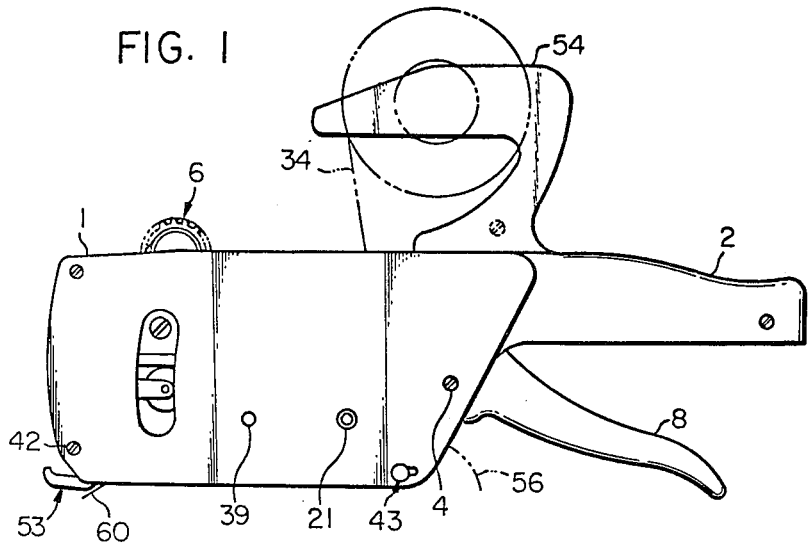
FIG. 1 is a side elevational view of a labelling machine illustrating a preferred embodiment of the invention.
Figure 2:
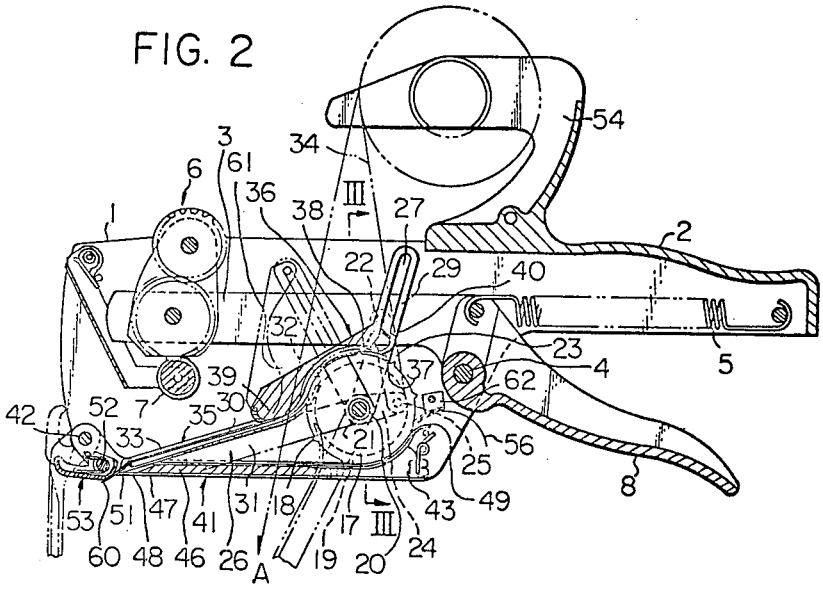
FIG. 2 is a vertical sectional view showing the internal construction of the labelling machine of FIG. 1.
Figure 3:
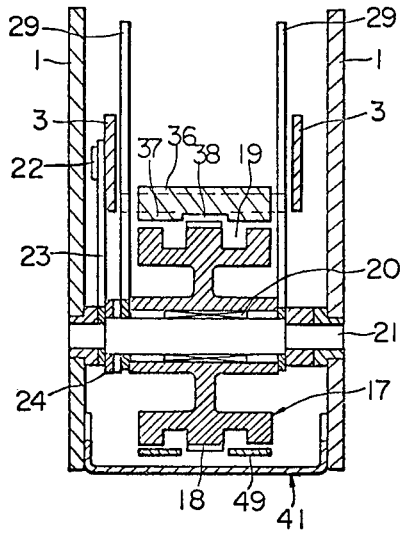
FIG. 3 is a sectional view taken along the plane of line III—III in FIG. 2 and viewed in the arrow direction.

With particular reference to FIGS. 1 and 2, the labelling machine illustrated therein by way of a preferred embodiment of this invention includes a framework or casing 1 which has a grip 2 formed substantially integral therewith and in which a lever 3 consisting of a pair of parallel strips of rigid material, as shown in FIG. 3, is swingably supported at 4 and is resiliently urged upwardly by a helical tension spring 5.

Printing means 6 of known configuration is mounted adjacent to the free end of the lever 3 and includes an inking roller 7 adapted to ink the printing surface of the printing means 6. A swingable grip lever 8 provided below the grip 2 at an angle thereto is formed substantially integral with the aforesaid lever 3 and is thus swingable on the pivot point 4.

Figure 10:
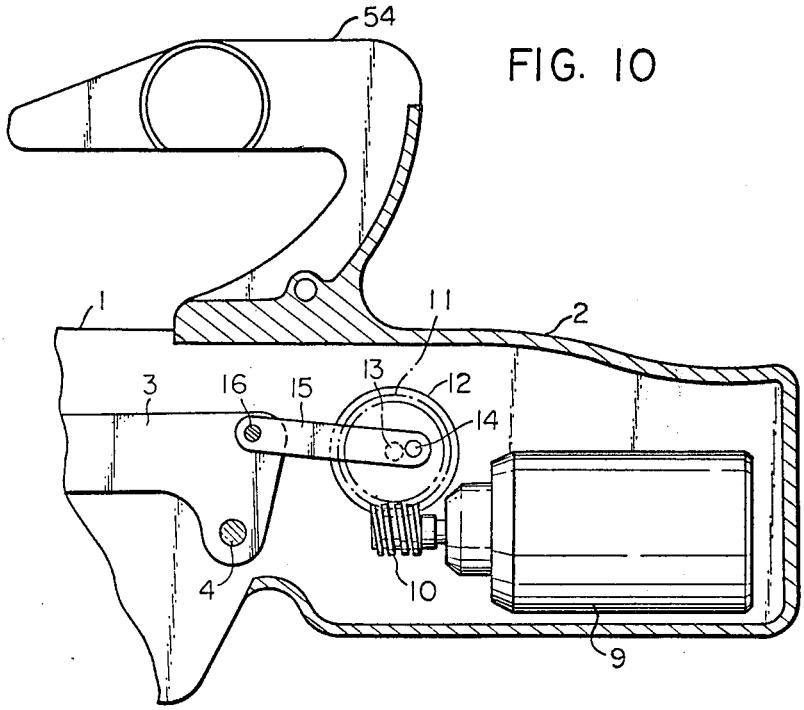
FIG. 10 is a fragmentary, vertical sectional view of a modified example of the labelling machine.

If desired, however, the grip lever 8 can be dispensed with by automating the swinging motion of the lever 3, as by means illustrated in FIG. 10. The grip 2 in the modified example of FIG. 10 is appropriately enlarged in size to house an electric motor 9 driven from any suitable power supply not shown in the drawing. A worm 10 is fixedly mounted on the drive shaft of the motor 9 and is meshed with a worm gear 11 mounted on one and the same shaft 13 as a disk 12 for simultaneous rotation therewith. A pin 14 is eccentrically planted on one face of the disk 12 to turnably support a connecting rod 15 at one end thereof, while the other end of this connecting rod 15 is pinned at 16 to the lever 3. Hence, as the disk 12 makes one complete revolution around the shaft 13, the lever 3 is caused to swing up and down on the pivot point 4.

Referring back to FIGS. 2 and 3 in particular, there is housed within the casing 1 a rotor 17 having a plurality of spaced-apart teeth 18 formed approximately centrally of its circumference, each tooth 18 having a relatively sharp-edged crest, as shown in FIG. 2, for purposes hereinafter made apparent. A pair of parallel grooves 19 are formed circumferentially of the rotor 17 on both sides of its teeth 18 as best shown in FIG. 3. The rotor 17 is mounted on a shaft 21 through a one-way clutch bearing 20 adapted to permit the rotor 17 to rotate only counterclockwise as viewed in FIG. 2.

A link 23 is swingably connected at one end thereof by a pin 22 to the lever 3 and at the other end to a rotatable member 24 by a pin 25. The member 24 is fixedly mounted on the aforesaid shaft 21 so that each time the grip lever 3 is released after having been pulled toward the grip 2, the rotor 17 is caused to rotate through a predetermined angle.

Figure 6:
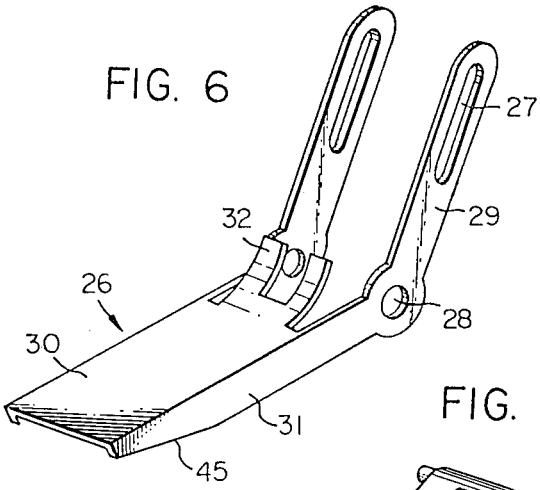
FIG. 6 is a perspective view of a guide member used in the labelling machine of FIG. 1.
Figure 7:
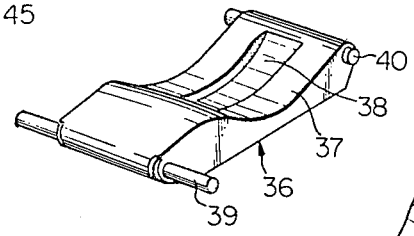
FIG. 7 is a perspective view of another guide member used in the labelling machine.

As shown in FIG. 2 and in more detail in FIG. 6, a guide generally designated by the numeral 26 is mounted inside of the pair of parallel strips constituting the aforesaid lever 3. The guide 26 includes a pair of parallel levers 29 having aligned slots 27 and aligned bores 28. The levers 29 are formed integrally with a base 30 on which the printing means 6 forms a desired inscription on each label in a manner hereinafter referred to. The base 30 has its both sides bent downwardly as indicated at 31 in FIG. 6 and is further provided with a pair of upwardly curved guides 32 to be somewhat loosely received in the circumferential grooves 19 of the rotor 17. The guide member 26 thus constructed is swingable on the shaft 21 which extends through the bores 28.

Figure 4:
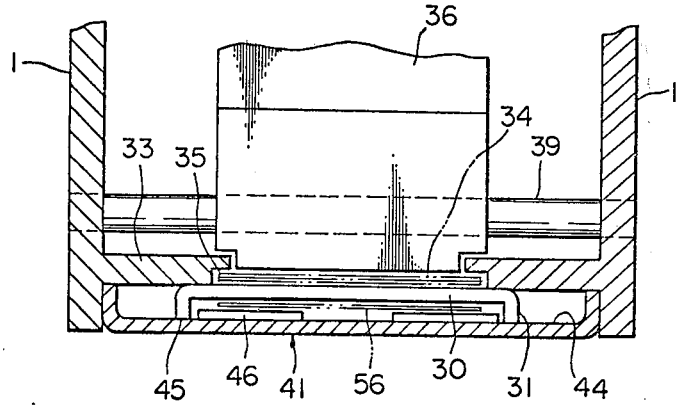
FIG. 4 is an enlarged sectional view taken along the plane of line VI—IV in FIG. 5 and viewed in the arrow direction.
Figure 5:
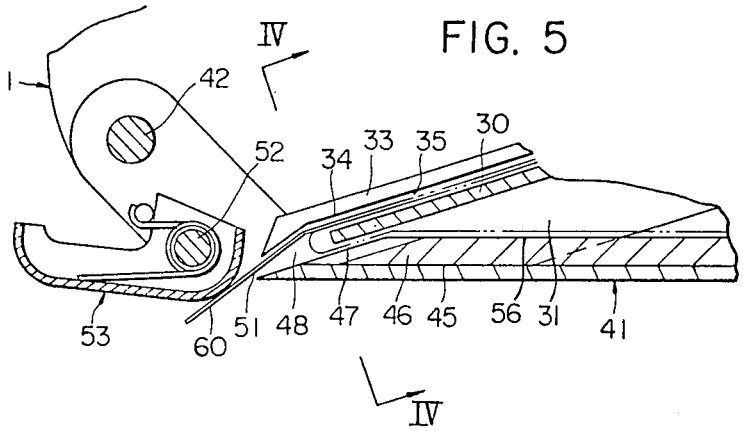
FIG. 5 is an enlarged, fragmentary side view, in vertical section, showing a curved passageway where labels are successively separated from their common backing strip.

With reference to FIGS. 2, 4 and 5, a pair of shelves 33 are formed on the confronting surfaces of the casing 1. The opposed edges of these shelves 33 are stepped as shown in FIG. 4 to provide a passageway 35 of a continuous label strip 34 when the upper surface of the base 30 is moved into contact with the lower surfaces of the shelves. The forward ends, seen to the left in FIGS. 2 and 5, of the shelves 33 are slightly bent downwardly for purposes hereinafter made apparent.

An upper guide 36, seen in FIGS. 2, 3, 4 and 7, is formed with an arcuate surface 37 adapted to direct the label strip 34 along the circumference of the rotor 17 and with an arcuate groove 38 to receive the teeth 18 of the rotor 17. The upper guide 36 is swingable on a pin 39 secured to the casing 1 on the back of the aforesaid shelves 33, and another pin 40 securely inserted through its rear end to be loosely received in the slots 27 of the parallel levers 29. It will be noted from FIG. 2 that the upper guide 36 extends over the upwardly curved guides 32 and the base 30 with an appropriate spacing therebetween to define a passageway for the label strip 34.

As will be seen from FIGS. 2, 4 and 5, an openable bottom 41 has its front end pinned at 42 to the casing 1 and is normally held in its closed position by lock means 43 shown in FIG. 2. The upper surface 44 of this openable bottom 41 in the closed position is urged against the abutments 45 formed by the downwardly bent portions 31 of the base 30, shown also in FIG. 6, so that the base 30 in turn is urged against the lower surfaces of the shelves 33.

A pair of guides 46 are formed on the upper surface 44 of the openable bottom 41, and as best illustrated in FIG. 5 these guides 46 have sloping edges 47 substantially in vertical register with the front ends of the shelves 33. In this manner a hairpin passageway 48 is formed for the label strip 34 by the base 30, the shelves 33, and the guides 46.

Figure 8:
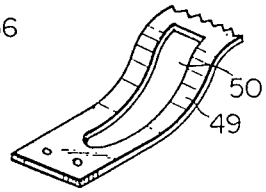
FIG. 8 is a perspective view of still another guide member used in the labelling machine.

It will be noted from FIGS. 2 and 8 that a curved guide 49 is fixedly mounted on the openable bottom 41 on the back of the guides 46 in order to direct a continuous strip of backing 56, from which the labels have been removed at the hairpin curve 48, along a lower portion of the circumference of the rotor 17. As illustrated in more detail in FIG. 8, the curved guide 49 is slotted at 50 to receive the successive teeth 18 of the rotor 17 with appropriate clearance. The backing strip 56 thus fed along the lower circumferential portion of the rotor 17 is separated therefrom by a member 62 affixed to the casing 1. Although not clearly seen in the drawings, it is assumed that the member 62 has a bifurcated portion which is loosely fitted in the parallel circumferential grooves 19 of the rotor 17.

With reference to FIGS. 1, 2 and 5, an aperture 51 is formed through the openable bottom 41 for dispensation of each label 60 separated as aforesaid from the continuous backing strip 56. The label 60 thus fed out of the aperture 51 is affixed to a desired article by label affixing means 53 of known construction swingably mounted on a pin 52 extending between the opposite walls of the openable bottom 41.

As shown in FIGS. 1 and 2, a holder 54 of prior design is formed on top of the casing 1 to support the roll of the continuous label strip 34 to be fed into the labelling machine.

Figure 9:
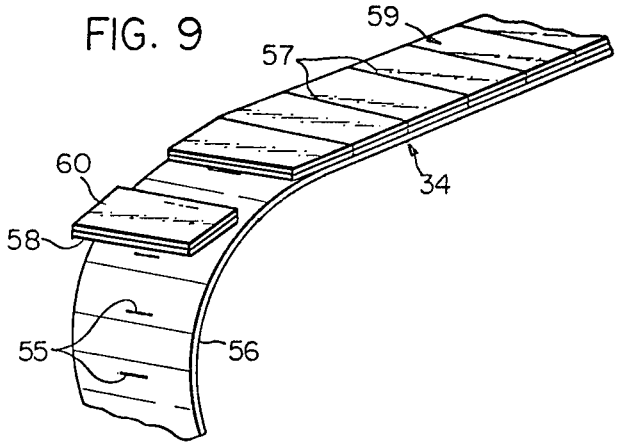
FIG. 9 is an enlarged, fragmentary perspective view of a continuous label strip for use with the labelling machine.

The continuous label strip for use with the labelling machine according to the invention is illustrated in detail in FIG. 9. Slits 55 are formed crosswise through the continuous backing strip 56 with spacings equal to the pitch of the teeth 18 on the rotor 17. A continuous strip of labels 59, with incisions formed at 57 to permit the labels to be separated from the backing strip 56 one by one as indicated by the numeral 60, is releasably laid over the backing strip 56 through a layer of pressure-sensitive adhesive 58. It is to be noted that the adhesive layer 58 is bonded integrally with the respective labels 59 but not with the backing strip 56. This can be accomplished by coating the surface of the backing strip 56 with an oil, such as silicone oil, which is incompatible with the pressure-sensitive adhesive in use.

For loading the labelling machine of the foregoing construction, the lock means 43 shown in FIG. 2 is released to open the bottom 41 by turning the same clockwise, as viewed in FIG. 2, on the pin 42. The guide member 26 is then turned counterclockwise on the shaft 21 to its position shown by the dot-and-dash lines in FIG. 2, so that the upper guide 36 is caused also to turn counterclockwise on the pin 39 as its pin 40 slidingly, moves upwardly along the slots 27 of the parallel levers 29 of the guide member 26. There is now formed a wide spacing 61 between the arcuate surface 37 of the upper guide and the toothed circumference of the rotor 17.

The roll of the continuous label strip 34 is mounted in position on the holder 54, and the leading end of the label strip 34 is manually threaded through the spacing 61 between the upper guide 36 and the rotor 17 so as to extend in the direction of the arrow A indicated in FIG. 2. The guide member 26 is then turned clockwise to return to its operative position shown by the solid lines in the drawing, with the result that the upper guide 36 is caused also to return to its operative position thereby pressing the continuous label strip 34 toward the circumference of the rotor 17. The teeth 18 of the rotor 17 properly engage the continuous label strip 34 by entering respective slits 55 of its backing strip 56 when the grip lever 8 is turned toward the grip 2 against the helical tension spring 5 and then released.

Only the backing 56 of the continuous label strip 34 now extending along the passageway 35 on the base 30 is doubled over at the hairpin passageway 48 and is thence carried under the rotor 17 until its slits 55 are properly caught by the teeth 18. The bottom 41 of the casing 1 is then returned to its closed position and is locked by the lock means 43.

For use, the grip 2 and the grip lever 8 are held in one hand, and the latter is digitally pulled toward the former and is then released, whereupon the label 60 duly printed and separated from the continuous backing strip 56 is dispensed out of the aperture 51 through a procedure set forth hereinbelow. When the grip lever 8 is pulled as aforesaid toward the grip 2 against the helical tension spring 5, the lever 3 is turned downwardly on the pin 4 together with the printing means 6 to print a desired inscription on the label 59 placed in position on the base 30. During the succeeding upward turn of the lever 3, caused by the release of the grip lever 8, the rotor 17 is turned counterclockwise through a predetermined angle by the cooperation of the link 23 and the member 24, so that the continuous label strip is caused to advance a predetermined distance equal to the pitch of the teeth 18 on the rotor 17. Simultaneously, the continuous backing strip 56, from which the labels 59 have been successively separated at the hairpin passageway 48 as previously mentioned, is fed the same distance over the guides 49 by the rotor 17 and is unloaded through the back of the casing 1.

It will be noted from FIG. 5 in particular that the backing strip 56 is doubled over at the hairpin passageway 48 with a certain intended slack so as not to contact the front edge of the base 30, in accordance with the prior art. This is calculated to facilitate the smooth advancement of the continuous label strip 34 and the removal of the successive labels 59 or 60 from the backing strip 56. Since the label strip 34 advances by indexed movement at exactly the same rate as the backing strip 56 is fed backwardly on the guides 46, the backing strip is permitted to retain its slack no matter how many times the grip lever 8 is actuated.

Each label 59 or 60 is considerably more rigid than the backing strip 56, and the label is laid over the backing in a readily releasable manner, so that the successive labels are separated from the backing strip as the latter is forcibly fed along the hairpin passageway 48. Each label thus dispensed out of the aperture 51 is placed on a desired article and rubbed against the same by the means 53 so that the label is affixed thereto through its layer 58 of pressure-sensitive adhesive.

I claim:

1. A labelling machine comprising a casing having side walls, a manual grip integrally formed with said casing, a lever pivotally supported by said casing for swingable movement through a predetermined angle within said casing, printing means mounted on and driven by said lever to print a desired inscription on a continuous label strip consisting of a series of labels releasably placed on a common backing strip, advancing means including a toothed feed rotor which rotates in one direction only for advancing said label strip by an indexed movement along an advancing passageway through said casing toward a dispensing opening of said casing by actuation of said lever, said labels being successively separated from said backing strip at the end of said passageway and being dispensed out of said dispensing opening while said backing strip is transferred rearwardly after separation of the labels therefrom by said toothed feed rotor, label affixing means for affixing a label separated from the backing strip and dispensed out of said dispensing opening onto a desired article, guide means for defining said advancing passageway, an openable bottom plate to facilitate loading of the continuous label strip, said guide means comprising a curved upper guide means disposed above said rotor to guide said label strip together with said rotor for indexed movement of the label strip, said curved guide means being provided with grooves for receiving the teeth of said rotor, a base plate for receiving thereon the label strip fed by said rotor through said curved upper guide means to support said label strip to permit printing on the labels by said printing means, said base plate projecting toward said dispensing opening but spaced therefrom and shelves projecting inwardly from said side walls of said casing so as to overlie said base plate and to define said advancing passageway together with said base plate, said shelves having front ends terminating at said dispensing opening; bottom guide means on said openable bottom plate of the casing, said bottom guide means having front ends terminated at a position adjacent the front ends of said shelves and facing the front end of said base plate while being tapered downwardly to define with said base plate a narrow passageway for rearward travel of the backing strip toward said rotor; said openable bottom plate having a tapered front end which defines together with the front ends of said shelves a narrow gap at the front end of said base plate whereby a hairpin passageway is formed in said narrow gap by the front end of said base plate, the front ends of said shelves and the front ends of said bottom guide means, said hairpin passageway being positioned to sharply bend the backing strip backwardly and introduce said backing strip into the narrow passageway formed between the front end of said base plate and the front ends of said bottom guide means thereby to define and retain a constant slack loop in said backing strip and to extend the backing strip rearwardly so as to be engaged with the underside of said rotor to dispense the backing strip backwardly over a length corresponding to the length of a label.

2. A labelling machine as claimed in claim 1 comprising means pivotably connecting the upper guide means and the base plate to move the same apart to facilitate initial loading of the continuous label strip therebetween.

3. A machine as defined in claim 1, wherein said rotor has a pair of parallel grooves on and around its circumference and a plurality of spaced-apart teeth between said pair of parallel grooves to engage said continuous label strip and said backing strip.

4. A machine as defined in claim 1, wherein said rotor has a pair of parallel grooves on and around its circumference and a plurality of spaced-apart teeth between said pair of parallel grooves to engage said continuous label strip and said backing strip, said bottom guide means being slotted to receive said teeth of said rotor with clearance.

5. A machine as defined in claim 1, wherein said base plate has a planar surface facing said shelves.

6. A machine as defined in claim 1, wherein said base plate has a front edge which is spaced upstream of said tapered front ends of said shelves.

* * * * *

UNITED STATES PATENT AND TRADEMARK OFFICE

CERTIFICATE OF CORRECTION

PATENT NO. : 4,026,758

DATED : May 31, 1977

INVENTOR(S) : Yo SATO

It is certified that error appears in the above-identified patent and that said Letters Patent are hereby corrected as shown below:

After line 5

Insert-Assignee -- Kabushiki Kaisha Sato Kenkyusho

Suginami-Ku, Tokyo-To, Japan --

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*